US005082051A

United States Patent [19]

Ando

[11] Patent Number: 5,082,051

[45] Date of Patent: Jan. 21, 1992

[54] HEAT EXCHANGER HAVING A CORROSION PREVENTION MEANS

[75] Inventor: Nobuyasu Ando, Takasaki, Japan

[73] Assignee: Sanden Corporation, Gunma, Japan

[21] Appl. No.: 490,758

[22] Filed: Mar. 8, 1990

[30] Foreign Application Priority Data

Mar. 8, 1989 [JP] Japan ..... 1-25508[U]

[51] Int. Cl.[5] ..... F28B 1/06; B21D 53/08

[52] U.S. Cl. ..... 165/110; 165/153; 165/173; 29/890.043; 29/890.052

[58] Field of Search ..... 165/110, 151, 152, 173, 165/175, 153; 29/890.043, 890.052

[56] References Cited

U.S. PATENT DOCUMENTS

| | | | |
|---|---|---|---|
| 2,105,241 | 1/1938 | Gazey | 29/890.052 |
| 3,307,622 | 3/1967 | Oddy | 165/151 |
| 3,310,868 | 3/1967 | La Porte et al. | 165/151 X |
| 3,689,972 | 9/1972 | Mosier et al. | 165/175 |
| 3,993,126 | 11/1976 | Taylor | 165/173 |
| 4,296,804 | 10/1981 | Press et al. | 165/173 X |
| 4,529,034 | 7/1985 | Saperstein | 165/134 |
| 4,569,390 | 2/1986 | Knowlton et al. | 165/149 |
| 4,615,385 | 10/1986 | Saperstein et al. | 165/175 |
| 4,663,812 | 5/1987 | Clausen | 165/173 X |
| 4,680,845 | 7/1987 | Miller | 165/173 X |
| 4,749,033 | 6/1988 | Clausen | 165/173 |
| 4,770,240 | 9/1988 | Dawson et al. | 165/178 |
| 4,825,941 | 5/1989 | Hoshino et al. | 165/110 |
| 4,829,780 | 5/1989 | Hughes et al. | 165/176 X |
| 4,877,083 | 10/1989 | Saperstein | 165/176 X |
| 4,936,381 | 6/1990 | Alley | 165/176 |

FOREIGN PATENT DOCUMENTS

| | | | |
|---|---|---|---|
| 243476 | 8/1960 | Australia | 165/175 |
| 41009 | 11/1958 | Poland | 165/175 |

*Primary Examiner*—Albert W. Davis, Jr.
*Assistant Examiner*—L. R. Leo
*Attorney, Agent, or Firm*—Banner, Birch, McKie & Beckett

[57] ABSTRACT

A heat exchanger for a refrigerant fluid circuit is disclosed which includes a plurality of tubes which have opposite first and second open ends. A plurality of fin units are disposed between the plurality of tubes. The first and second header pipes have at least one open end and are fixedly disposed at the first and second opposite open ends of the tubes, respectively. The open ends of the tubes are disposed in fluid communication with the interior of the header pipes, and the heat exchanger is linked in fluid communication to external elements of the circuit through the first and second header pipes. The first and second header pipes are respectively formed by bending rectangular plate members into a tubular shape, and the rectangular plate members have a plurality of slits and joint portions such that when the plate is bent into the tubular shape slots are formed for the insertion of the ends of the tubes. Extensible joints are formed by the joint portions such that when the plate member is bent into a tubular shape the joint portions will project outwardly from the circumference. The rectangular plates are made of aluminum clad plates which include aluminum and brazing materials coated on at least one surface of the aluminum cores. A heat exchanger results, thus having a high corrosion resistance and deformation resistance to high pressure fluid passing through the header pipe. Also, the heat exchanger can be manufactured inexpensively.

25 Claims, 7 Drawing Sheets

HEAT EXCHANGER HAVING A CORROSION PREVENTION MEANS

BACKGROUND OF THE INVENTION

1. Technical Field

The present invention relates to a heat exchanger, and more particularly, to a heat exchanging condenser for use in an automotive air-conditioning system.

2. Description of the Prior Art

With reference to FIG. 1, a conventional refrigerant circuit for use, for example, in an automotive air-conditioning system is shown. Circuit 1 includes compressor 10, heat exchanger 20, receiver or accumulator 30, expansion device 40, and evaporator 50 serially connected through pipe members 60 which link the outlet of one component with the inlet of a successive component. The outlet of evaporator 50 is linked to the inlet of compressor 10 through pipe member 60 so as to complete the circuit. The links of pipe members 60 to each component of circuit 1 are made such that the circuit is hermetically sealed.

In operation of circuit 1, refrigerant gas is drawn from the outlet of evaporator 50 and flows through the inlet of compressor 10, and is compressed and discharged to heat exchanger 20. The compressed refrigerant gas in heat exchanger 20 radiates heat to an external fluid flowing through heat exchanger 20, for example, atmosphere air, and condenses to the liquid state. The liquid refrigerant flows to receiver 30 and is accumulated therein. The refrigerant in receiver 30 flows to expansion device 40, for example, a thermostatic expansion valve, where the pressure of the liquid refrigerant is reduced. The reduced pressure liquid refrigerant flows through evaporator 50, and is vaporized by absorbing heat from a fluid flowing through the evaporator, for example, atmospheric air. The gaseous refrigerant then flows from evaporator 50 back to the inlet of compressor 10 for further compression and recirculation through circuit 1.

With further reference to FIGS. 1*a*, and 2-5, a prior art embodiment of heat exchanger 20 as disclosed in Japanese Patent Application Publication No. 63-112065 is shown. Heat exchanger 20 includes a plurality of adjacent, essentially flat tubes 21 having an oval cross-section and open ends which allow refrigerant fluid to flow therethrough. A plurality of corrugated fin units 22 are disposed between adjacent tubes 21. Circular header pipes 23 and 24 are disposed perpendicularly to flat tubes 21 and may have, for example, a clad construction. Each header pipe 23 and 24 includes outer tube 26 which may be made from aluminum and inner tube 28 made of a metal material which is brazed to the inner surface of outer tube 26. Outer tube 26 has slits 27 disposed therethrough. Flat tubes 21 are fixedly connected to header pipes 23 and 24 and are disposed in slits 27 such that the open ends of flat tubes 21 communicate with the hollow interior of header pipes 23 and 24. Inner tube 28 includes portions 28*a* which define openings corresponding to slits 27. Portions 28*a* are braced to the inner ends of flat tubes 21 and ensure that tubes 21 are hermetically sealed within header pipes 23 and 24 when inserted in slits 27.

Header pipe 23 has an open top end and a closed bottom end. The open top end is sealed by inlet union joint 23*a* which is fixedly and hermetically connected thereto. Inlet union joint 23*a* is linked to the outlet of compressor 10. Partition wall 23*b* is fixedly disposed within first header pipe 23 at a location about midway along its length and divides header pipe 23 into upper cavity 231 and lower cavity 232 which is isolated from upper cavity 231. Second header pipe 24 has a closed top end and an open bottom end. The open bottom end is sealed by outlet union joint 24*a* fixedly and hermetically connected thereto. Outlet union joint 24*a* is linked to the inlet of receiver 30. Partition wall 24*b* is fixedly disposed within second header pipe 24 at a location approximately one-third of the way along the length of second header pipe 24 and divides second header pipe 24 into upper cavity 241 and lower cavity 242 which is located from upper cavity 241. The location of partition wall 24*b* is lower than the location of partition wall 23*a*.

In operation, compressed refrigerant gas from compressor 10 flows into upper cavity 231 of first header pipe 23 through inlet union joint 23*a*, and is distributed such that a portion of the gas flows through each of flat tubes 21 which are disposed above the location of partition wall 23*b*, and into an upper portion of upper cavity 241. Thereafter, the refrigerant in the upper portion of cavity 241 flows downward into a lower portion of upper cavity 241, and is distributed such that a portion flows through each of the plurality of flat tubes 21 disposed below the location of partition wall 23*b* and above the location of partition wall 24*b*, and into an upper portion of lower cavity 232 of first header pipe 23. The refrigerant in an upper portion of lower cavity 232 flows downwardly into a lower portion, and is again distributed such that a portion flows through each of the plurality of flat tubes 21 disposed below the location of partition wall 24*b*, and into lower cavity 242 of second header pipe 24. As the refrigerant gas sequentially flows through flat tubes 21, heat from the refrigerant gas is exchanged with the atmospheric air flowing through corrugated fin units 22 in the direction of arrow W as shown in FIG. 5. Since the refrigerant gas radiates heat to the outside air, it condenses to the liquid state as it travels through tubes 21. The condensed liquid refrigerant in cavity 242 flows out therefrom through outlet union joint 24*a* and into receiver 30 and the further elements of the circuit as discussed above.

With reference to FIG. 6, a conventional heat exchanger which is disclosed in U.S. Pat. No. 4,615,385, issued in the name of Saperstein et al., is shown. Heat exchanger 130 includes first and second header pipes 100 which have a plurality of slots 200. These slots are for the insertion of ends of flat tubes 300 as explained with regard to FIG. 2 above. Dome-shaped portions 220 are positioned between the respective slots 200 formed through header pipes 100.

Since the pressure difference between the fluid and the atmosphere can be great, the area adjacent the slots must be strengthened to increase the pull out resistance of the tubes 300. Dome-shaped portions 220 are designed to improve the pull out resistance force of header pipe 100 to prevent the deformation of the header pipe caused by high pressure fluid in the header pipes 100.

However, if there is a dome-shaped portion between respective slots 200 on header pipe 100 as shown in FIG. 7, channels 210 are defined between the outer surfaces of flat tubes 300 and dome-shaped portions 220. Channels 210 create dead spaces so that air passing therethrough does not perform a heat exchange function because corrugated fin units 400 are not disposed in the space of channels 210. In addition, since condensed water can be more easily accumulated at channels 210 as compared with the other portions of the heat exchanger, an oxygen concentration cell may be formed, and corrosion may occur on header pipes 100.

Other problems of conventional heat exchangers are described below. Dome-shaped portions 220 are formed on header pipe 100 which is generally made of clad materials. These clad materials can be a layer or layers of brazing materials coated on the outer surface of an aluminum core. In heat exchanger 130 with header pipes 100 using the above clad materials, if the top end surfaces of dome-shaped portions 220 contact the end of corrugated fin unit 400, which is also made of aluminum, while being heated in a furnace, fin units 400 will become brazed to dome-shaped portions 220. As shown in FIG. 8, which shows the heat exchanger 130 before heating, contact between the dome-shaped portions 220 and corrugated fin units is slight. After heating, the longitudinal length of corrugated fin units 400 is expanded, thus deforming the ends of the units as shown in FIG. 9. The same process occurs for all fin unit ends thus decreasing the strength of all corrugated fin units.

The process of brazing fin units 400 to the outer surface of header pipes 100 occurs as follows. Brazing material 100*b* which is on the outer surface of header pipes 100 adheres to corrugated fin units 400 that are in contact with header pipes 100. Silicon contained in brazing material 100*b* is diffused into corrugated fin units 400. The melting point of corrugated fin unit 400 is dependent upon the silicon content and the atmospheric temperature in the furnace, therefore, the more silicon that diffuses into corrugated fin unit 400 the lower the melting point. Upon sufficient silicon diffusing into corrugated fin units 400, the ends of the fins units melt as shown in FIG. 9. The resultant channel or dead space 210 causes a problem in that inefficient heat transfer results. Accordingly, in order to avoid this problem it is necessary to assemble the heat exchanger such that there is no contact between header pipes 100 and corrugated fin units 400. This can be accomplished by inserting spacers between dome-shaped portions 220 and corrugated fin units 400; however, this is an expensive and time consuming solution to the problem.

Another solution to the problem of creating channels 210 is to weld header pipes 100 to flat tubes 300. This solution is extremely expensive and labor intensive. Heat exchangers made by this method are prohibitively expensive.

SUMMARY OF THE INVENTION

The present invention is directed to a heat exchanger for a refrigerant fluid circuit. The heat exchanger includes a plurality of tubes having opposite first and second open ends, and a plurality of fin units disposed between the plurality of tubes. First and second header pipes are fixedly disposed at the opposite ends respectively, and the open ends of the tubes are disposed in fluid communication with the interior of the header pipes. The heat exchanger is linked in fluid communication with the other elements of the refrigerant fluid circuit.

The first and second header pipes are each formed by bending a rectangular plate to form a tubular member. Each rectangular plate is formed with a pair of oppositely facing edges having a plurality of parallel slits. The slits define parallel joint portions. When the rectangular plate is bent into a tubular member, the joint portions on the opposite sides of the plate are designed to engage one another such that the slits align to form slots. The joint portions are further designed to extend towards the fin units when the heat exchanger is constructed such that the tubes fit within the slots. Further, the plate is formed of aluminum clad plates having aluminum cores and brazing material coated on at least one surface of the aluminum cores.

It is an advantage of the present invention to construct a heat exchanger which is highly resistant to corrosion.

Another advantage of the present invention is that deformation of the header pipe due to high pressure fluid passing therethrough can be alleviated.

A still further advantage of the present invention is to manufacture a heat exchanger inexpensively.

Further objects, features and aspects of this invention will be understood from the following detailed description of the preferred embodiments of this invention with reference to the drawings.

DETAILED DESCRIPTION OF THE PREFERRED EMBODIMENTS

Figure 1:
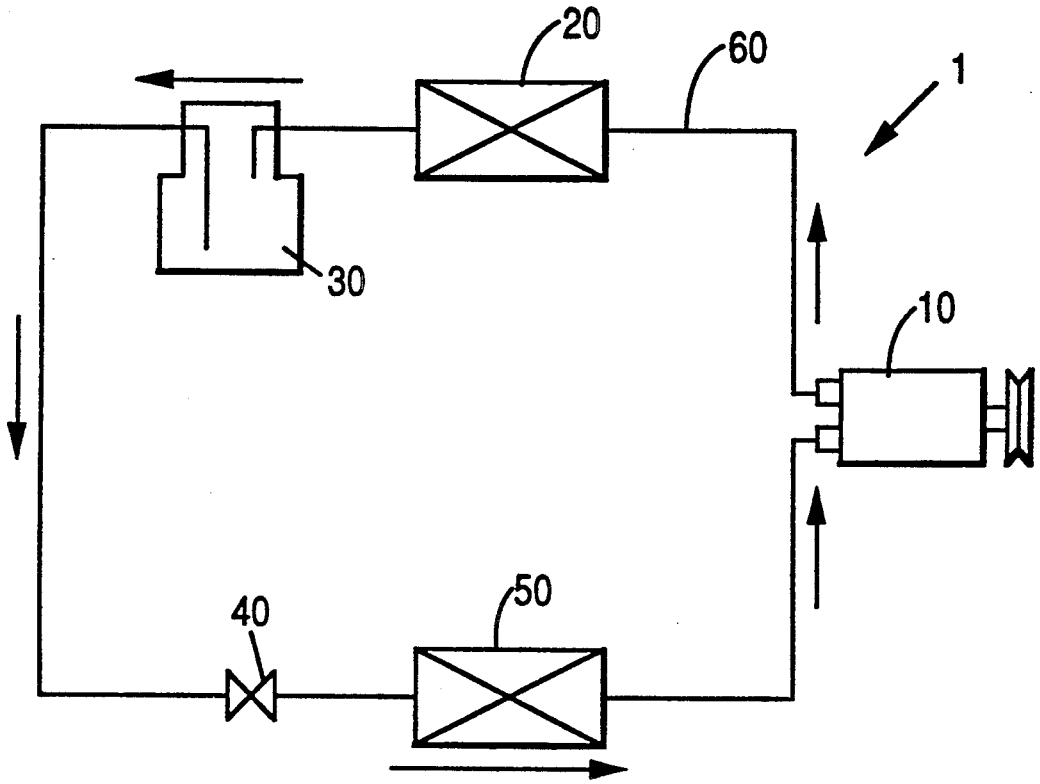
FIG. 1 PRIOR ART
FIG. 1 is a schematic block diagram of a refrigerant circuit in accordance with the prior art.
Figure 2:
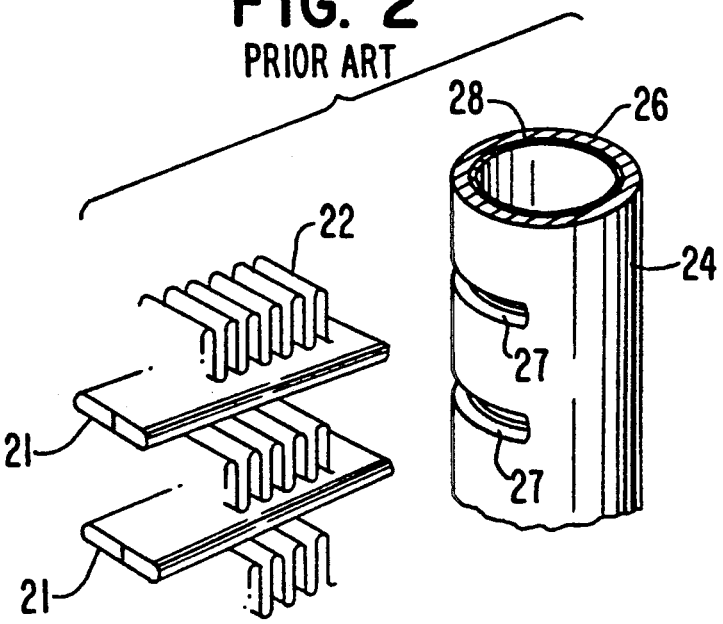
FIG. 2 PRIOR ART
FIG. 2 is a perspective view of certain elements of the heat exchanger shown in FIG. 1*a*.
Figure 1A:
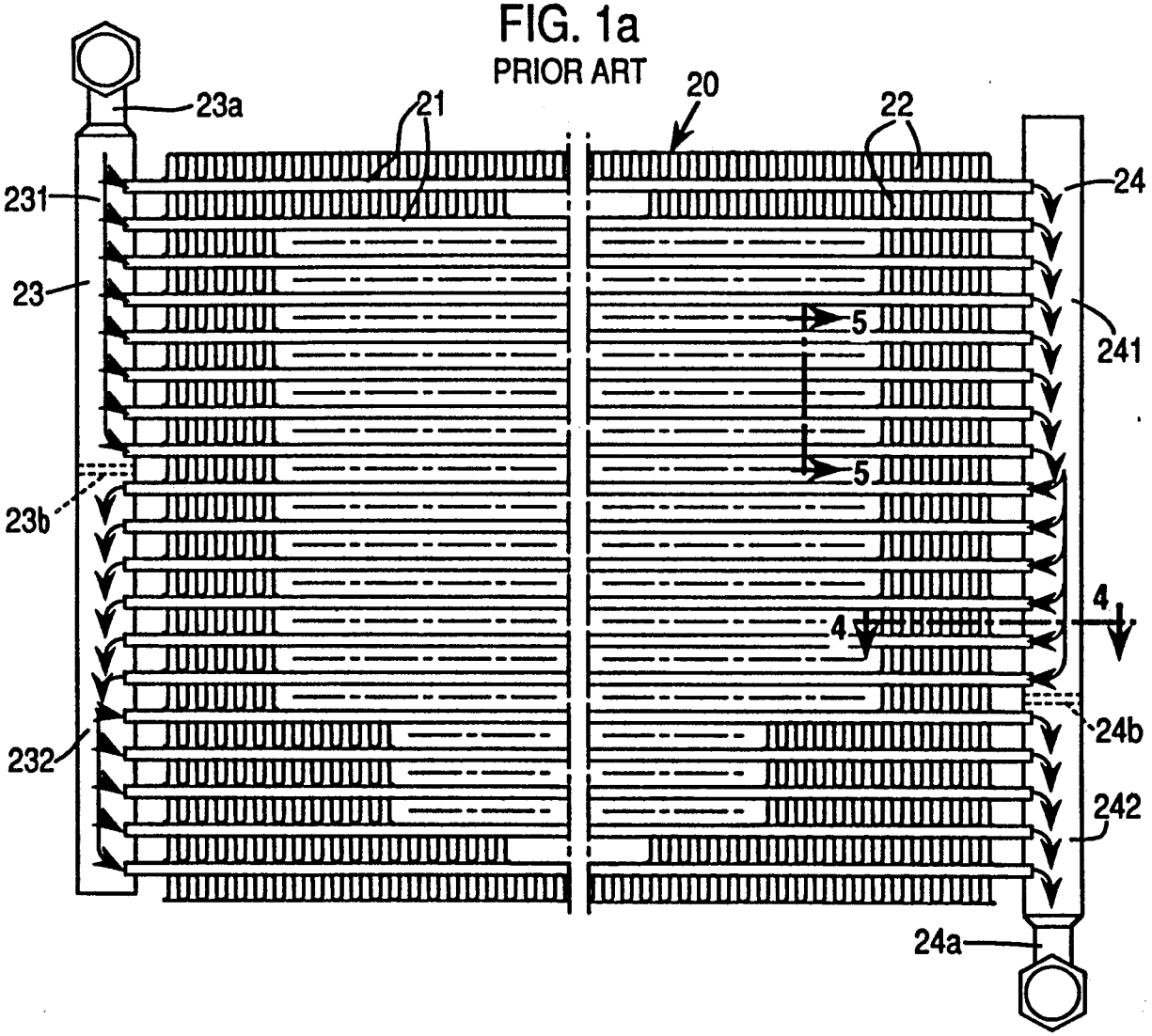
FIG. 1a PRIOR ART
FIG. 1*a* is an elevational view of the heat exchanger shown in the refrigerant circuit of FIG. 1.
Figure 3:
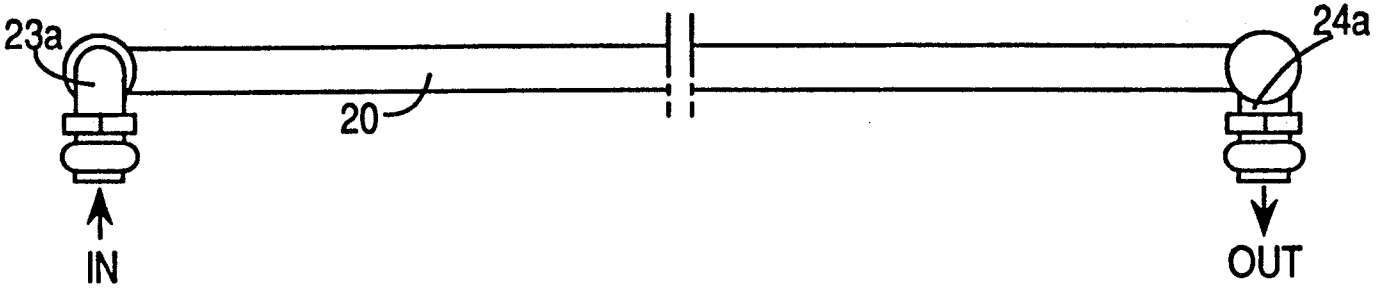
FIG. 3 PRIOR ART
FIG. 3 is a top plan view of the heat exchanger shown in the prior art of FIG. 1*a*.
Figure 5:
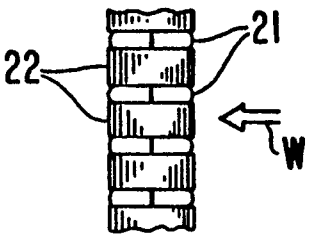
FIG. 5 PRIOR ART
FIG. 5 is a partial cross-section along line 5—5 in FIG. 1*a*.
Figure 4:
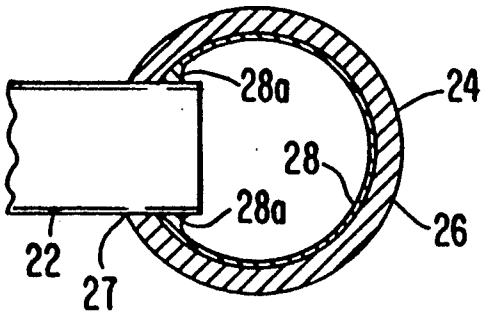
FIG. 4 PRIOR ART
FIG. 4 is a partial cross-section along line 4—4 in FIG. 1*a*.
Figure 6:
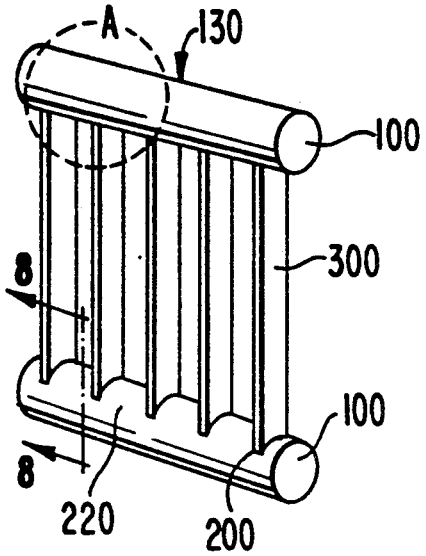
FIG. 6 PRIOR ART
FIG. 6 is a schematic perspective view of another prior art heat exchanger.
Figure 7:
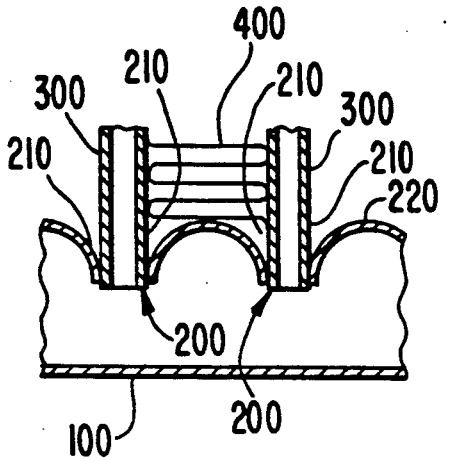
FIG. 7 PRIOR ART
FIG. 7 is a cross-sectional view of a part of the heat exchanger labeled A as shown in FIG. 6.
Figure 8:
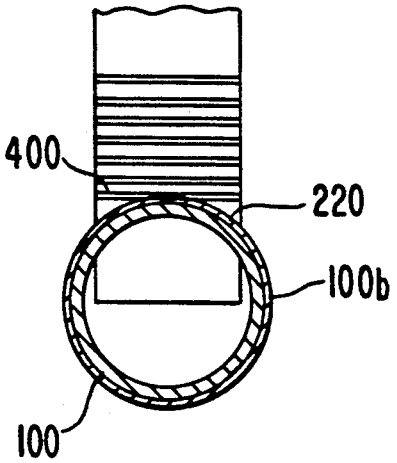
FIG. 8 PRIOR ART
FIG. 8 is a partial sectional view of the heat exchanger shown in FIG. 6 along the line 8—8.
Figure 9:
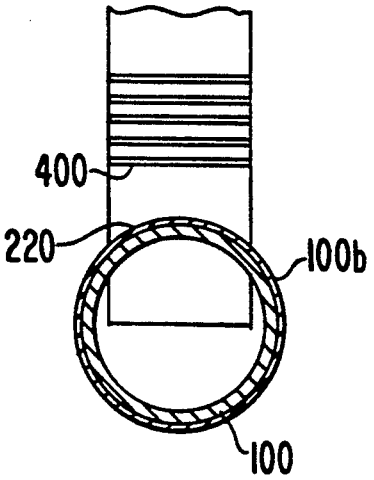
FIG. 9 PRIOR ART
FIG. 9 is another partial section view of the heat exchanger shown in FIG. 6 similar to FIG. 8.
Figure 10:
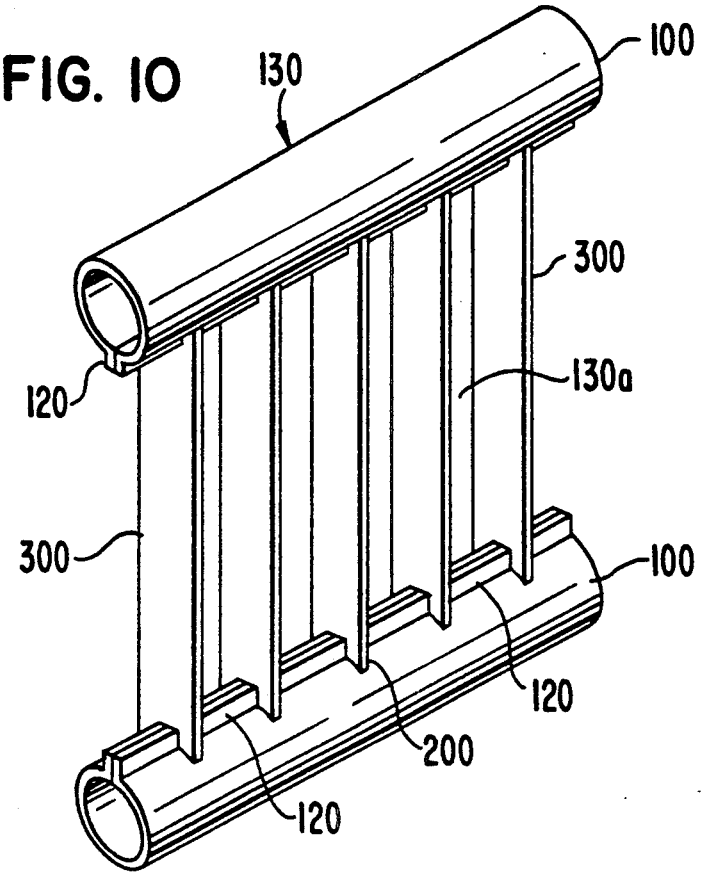
FIG. 10 is a schematic perspective view of a heat exchanger in accordance with one embodiment of the invention.
Figure 11:
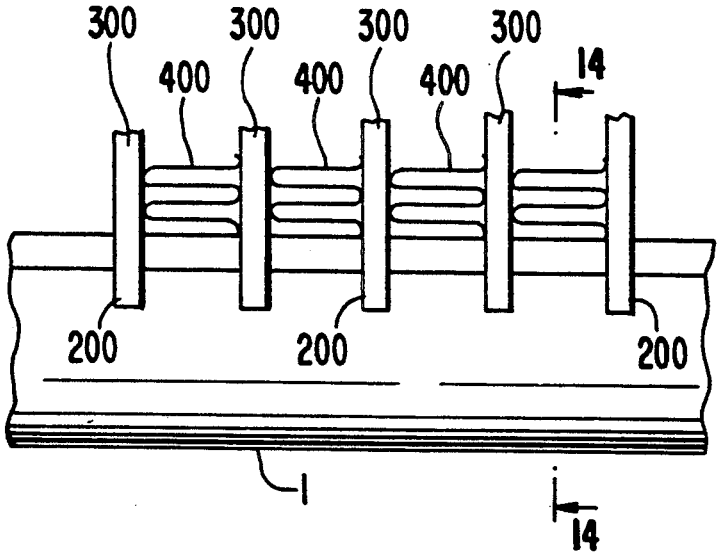
FIG. 11 is a partial frontal view of the heat exchanger shown in FIG. 10.

With reference to FIGS. 10 and 11, a heat exchanger in accordance with a first embodiment of the present invention is shown. In the Figures, the same reference numerals are used to denote corresponding elements shown in the prior art figures. Therefore, a complete explanation of those elements is omitted. Heat exchanger 130 includes a plurality of flat or planar tubes 300, and a plurality of corrugated fin units 400, which are omitted in FIG. 10. These fin units 400 are alternately arranged and form heat exchange region 130*a*. Flat tubes 300 are made of aluminum and have a multi-hollow construction, that is, flat tubes 300 include a plurality of longitudinally disposed dividing walls such that each flat tube includes a plurality of parallel flow paths. This construction increases the surface area of the refrigerant fluid contacts as it flows through the flat tubes. Flat tubes 300 are disposed in slots 200 in each header pipe 100. Header pipes 100 are positioned such that they are disposed at opposite ends of the flat tubes 300.

Figure 12:
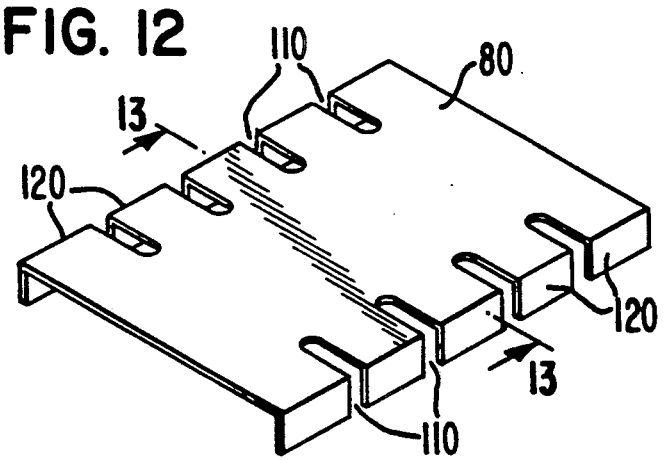
FIG. 12 is a perspective view of a rectangular plate member prior to being formed into a header pipe as shown in FIGS. 10 and 11.

Open-ended header pipes 100 are cylindrical and preferably made of clad materials. As shown in FIG. 12, each header pipe 100 is formed into tubular shape by bending a rectangular plate member 80. Slits 110 and joint portions 120 are formed along parallel and opposite sides of the rectangular plate member 80. Slits 110 and joint portions 120 are made such that they are parallel to one another and alternate along each respective side of the rectangular plate member 80. The parallel opposite side edges of the rectangular plate member are joined such that the respective opposite joint portions 12 are joined to one another such as to form an extensible joint. Slits 110 and joint portion 120 are joined such that the respective opposite slits and joint portions are matched, respectively. Slots 200 are formed by opposing slits 110 simultaneously as the joining of joint portions 120.

Figure 13:
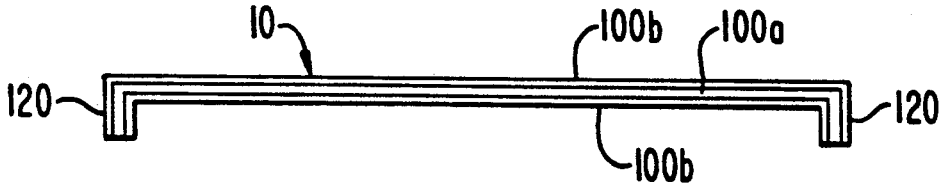
FIG. 13 is a cross-sectional view of the rectangular plate member taken along line 13—13 as shown in FIG. 12.

Joint portions 120 are formed by bending so that they will project toward the side of corrugated fin units 400 at right angle. Rectangular plate members 80 are made of aluminum clad plates which includes at least one aluminum core 100*a* and brazing 100*b* coated on both outer surfaces of the core 100*a*, as shown in FIG. 13. Additionally, an aluminum clad plate which includes brazing materials coated on one surface thereof is also envisioned. The header pipe is then formed by disposing the brazing materials at the inner surface of the tubular header pipe 100.

Figure 14:
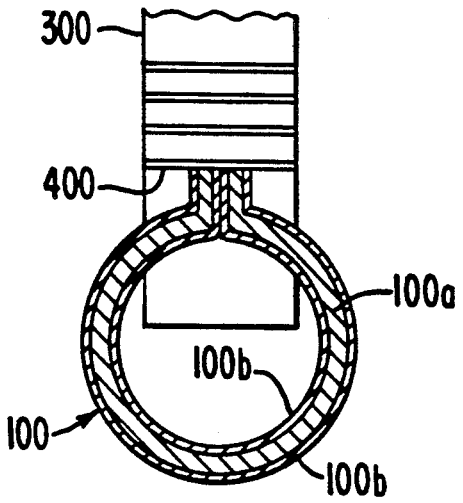
FIG. 14 is a cross-sectional view of a part of the heat exchanger taken along line 14—14 as shown in FIG. 11.

As shown in FIG. 14, the end of joint portions 120 of respective header pipes 100 contact the end surface of corrugated fin units 400, such that no gap is created therebetween. In addition, the brazing materials of header pipes 100 contact the ends of corrugated fin units 400 at only the end surfaces of the joint portions 120. Accordingly, very little silicon in the brazing materials is diffused into corrugated fin units 400. The problems of dead space formation and silicon diffusion as mentioned above are resolved by this embodiment of the invention.

Figure 15:
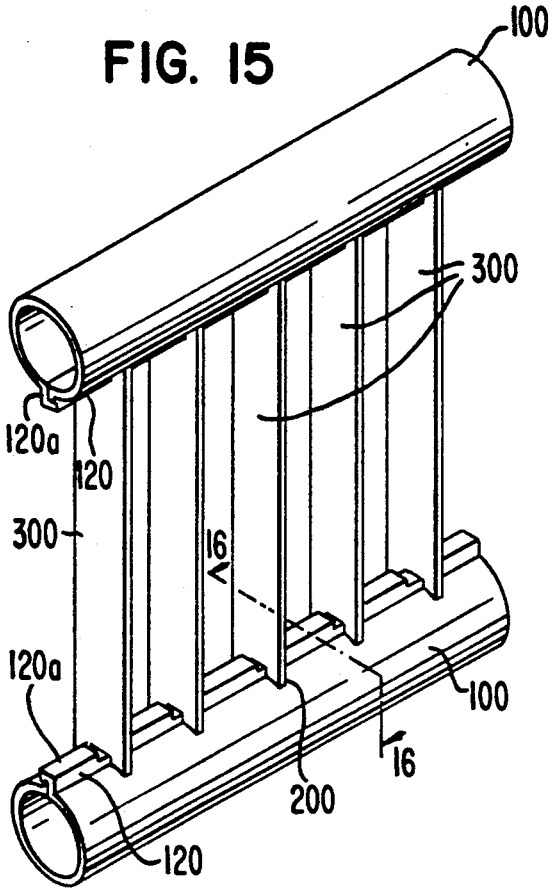
FIG. 15 is a schematic perspective view of a heat exchanger in accordance with another embodiment of the invention.
Figure 16:
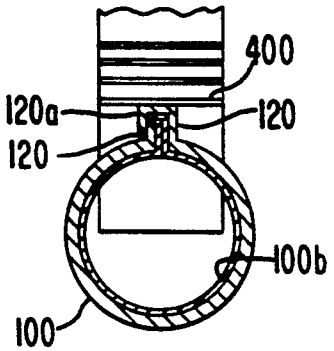
FIG. 16 is a cross-sectional view of a part of the heat exchanger shown in FIG. 15 taken along line 16—16.

With reference to FIGS. 15 and 16 a heat exchanger in accordance with a second embodiment of the invention is shown. One of the joint portions 120 of each header pipe 100 has an L-shaped securing portion 120*a*. Securing portion 120*a* is designed to cover the other joint portion 120. Because header pipe 100 is formed into a tubular shape by bending rectangular plate member 80, a gap between joint portions 120 may occur due to inaccuracies in the bending process and cutting of the rectangular plate member 80. Securing portion 120*a* securely joins both joint portions 120 of header pipes 100. An aluminum clad plate is used to form a header pipe according to this embodiment. Brazing materials are coated on the inner surface of the rectangular plate member 80 for joining the joint portions together.

Figure 17:
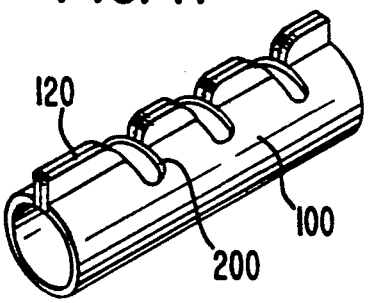
FIG. 17 is a schematic perspective view of a part of the header pipe in accordance with another embodiment of the invention.
Figure 18:
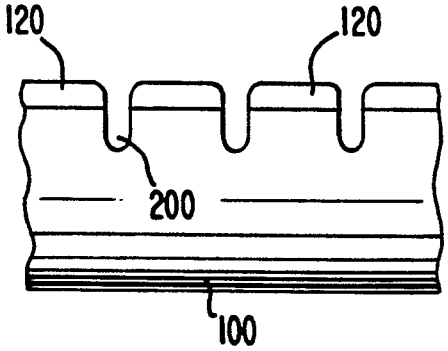
FIG. 18 is a side view of the header pipe shown in FIG. 17.

FIGS. 17 and 18 show the joint portions of a header pipe in a heat exchanger in accordance with a third embodiment of the invention. The outer corners of joint portions 120 adjacent slits 200 are arcuate such that the corners are rounded. These rounded corners facilitate the insertion of flat tubes 300.

This invention has been described in detail in connection with the preferred embodiments. These embodiments, however, are merely for example only and the invention is not restricted thereto. It will be easily understood by those skilled in the art that other variations and modifications can easily be made within the scope of this invention, as defined by the appended claims.

I claim:

1. A heat exchanger for a refrigerant fluid circuit comprising:

a plurality of tubes having opposite first and second open ends;

a plurality of fin units disposed between said plurality of tubes;

first and second header pipes each having at least one open end, said first and second header pipes being fixed at said opposite first and second open ends of said tubes with said first and second open ends of said tubes disposed in fluid communication with the interior of said header pipes; said first and second header pipes each being formed by bending a rectangular plate member into a tubular shape, each said rectangular plate member having a plurality of slits and joint portions on opposite parallel sides so that, when said opposite parallel sides of said rectangular plate are brought together, said plurality of slits on each respective side of said rectangular plate are combined to form a plurality of slots for insertion of said plurality of tubes and said joint portions are brought together to form a joint which projects towards said fin units, with said fin units being positioned closely adjacent to said joint portions before and after said plurality of tubes are permanently joined to said header pipe.

2. The heat exchanger of claim 1 wherein said joint portions on one side of said rectangular plate member include L-shaped securing portions for securely covering the other said joint portions.

3. The heat exchanger of claim 1 or 2 wherein the outer corners of said joint portions are arcuate to facilitate the insertion of the ends of the said tubes into the interior of said header pipes.

4. The heat exchanger of claim 1 wherein said rectangular plate member is made of aluminum clad plates having an aluminum core with brazing material coated on at least one surface.

5. The heat exchanger of claim 1 wherein said rectangular member is made of aluminum clad plates with brazing material coated on opposite surfaces of said aluminum plate.

6. The heat exchanger of claim 4 wherein after said rectangular plate member is formed into a tubular shape the ends of said joint portions are adapted to engage the ends of said fin units.

7. A refrigerant circuit comprising a compressor, a heat exchanger, a receiver, an expansion element and an evaporator sequentially disposed, said heat exchanger comprising a plurality of tubes having opposite first and second open ends, a plurality of fin units disposed between said plurality of tubes, first and second header pipes fixedly disposed at said first and second opposite open ends of said tubes, respectively, said open ends of said tubes disposed in fluid communication with the interior of said header pipes, said heat exchanger having an inlet means for linking the heat exchanger to an external element of the circuit and an outlet means for linking the heat exchanger to another external element of the circuit, said first and second header pipes each being formed from a bendable rectangular plate member having opposite parallel sides with slits cut therein and joint portions whereupon bending said rectangular plate into a tubular shape, said respective opposite sides having said slits are brought together to form slots for the insertion of said tubes and said joint portions are brought together to form an extensible joint, and wherein said fin units are positioned closely adjacent to said joint portions before and after said plurality of tubes are permanently joined to said header pipe.

8. The refrigerant circuit of claim 7 wherein said joint portions on one side of said rectangular plate member include L-shape securing portions for securely covering the other said joint portions.

9. The refrigerant circuit of claims 7 or 8 wherein the outer corners of said joint portions are arcuate to facilitate insertion of the ends of the said tubes into the interior of said header pipes.

10. The heat exchanger of claim 7 wherein said rectangular plate member is made of aluminum clad plates having an aluminum core with brazing material coated on at least one surface.

11. The heat exchanger of claim 7 wherein said rectangular member is made of aluminum clad plates with brazing material coated on opposite surfaces of said aluminum plate.

12. In a heat exchanger, a header pipe comprising:

a rectangular plate member bent into a tubular shape to form said header pipe;

said rectangular plate member having opposite parallel sides with slits cut therein and joint portions, whereupon when said rectangular plate member is bent into a tubular shape said slits align to form slots and said joint portions are attached and extend outwardly from the outer circumference of said tubular shape to form an extensible joint.

13. The header pipe of claim 12 wherein one set of said joint portions on one side of said rectangular plate member include L-shaped securing portions for securely covering the other said joint portions.

14. The header pipe of claim 12 or 13 wherein the outer corners of said joint portions are arcuate to facilitate insertion of the ends of tubes into the interior of said header pipe.

15. The header pipe of claim 12 wherein said rectangular plate member is made of aluminum clad plates having an aluminum core with brazing material coated on at least one surface.

16. The header pipe of claim 12 wherein said rectangular member is made of aluminum clad plates with brazing material coated on both sides of opposite surfaces of said aluminum plate.

17. A heat exchanger for a refrigerant fluid circuit comprising:

a plurality of tubes having opposite first and second open ends;

a plurality of fin units disposed between said plurality of tubes;

first and second header pipes each having at least one open end, said first and second header pipes being fixed at said opposite first and second open ends of said tubes with said first and second open ends of said tubes disposed in fluid communication with the interior of said header pipes; said first and second header pipes each being formed by bending an aluminum clad rectangular plate member into a tubular shape, said rectangular plate having an aluminum core and brazing material coated on at least one surface of said rectangular plate, each said rectangular plate member having a plurality of slits and joint portions on opposite parallel sides so that, when said opposite parallel sides of said rectangular plate are brought together, said plurality of slits on each respective side of said rectangular plate are combined to form a plurality of slots for insertion of said plurality of tubes and said joint portions are brought together to form a joint which projects towards said fin unit.

18. A refrigerant circuit comprising a compressor, a heat exchanger, a receiver, an expansion element and an evaporator sequentially disposed, said heat exchanger comprising a plurality of tubes having opposite first and second open ends, a plurality of fin units disposed between said plurality of tubes, first and second header pipes fixedly disposed at said first and second opposite open ends of said tubes, respectively, said open ends of said tubes disposed in fluid communication with the interior of said header pipes, said heat exchanger having an inlet means for linking the heat exchanger to an external element of the circuit and an outlet means for linking the heat exchanger to another external element of the circuit, said first and second header pipes each being formed from a bendable aluminum clad rectangular plate member having an aluminum core and opposite parallel sides with slits cut therein and joint portions, said rectangular plate member being coated on at least one side with a brazing material, whereupon bending said rectangular plate member into a tubular shape, said respective opposite sides having said slits are brought together to form slots for the insertion of said tubes and said joint portions are brought together to form an extensible joint.

19. In a heat exchanger, a header pipe comprising:

an aluminum clad, aluminum core rectangular plate member having brazing material coated on at least one surface, bendable into a tubular shape to form said header pipe;

said rectangular plate member having opposite parallel sides with slits cut therein and joint portions, whereupon bending said rectangular plate member into a tubular shape said slits align to form slots and said joint portions are attached and extend outwardly from the outer circumference of said tubular shape to form an extensible joint.

20. A heat exchanger for a refrigerant fluid circuit comprising:

a plurality of tubes having opposite first and second open ends;

a plurality of fin units disposed between said plurality of tubes;

first and second header pipes each having at least one open end, said first and second header pipes being fixed at said opposite first and second open ends of said tubes with said first and second open ends of said tubes disposed in fluid communication with the interior of said header pipes; said first and second header pipes each being formed by bending a rectangular plate member into a tubular shape to create a seamed pipe, each said rectangular plate member having a plurality of slits and joint portions on opposite parallel sides so that, when said opposite parallel sides of said rectangular plate are brought together, said plurality of slits on each respective side of said rectangular plate are combined to form a plurality of slots for insertion of said plurality of tubes and said joint portions are brought together to form a joint which projects towards said fin units.

21. The heat exchanger of claim 20 wherein said joint portions on one side of said rectangular plate member include L-shaped securing portions for securely covering the other said joint portions.

22. The heat exchanger of claim 20 or 21 wherein the outer corners of said joint portions are arcuate to facilitate the insertion of the ends of the said tubes into the interior of said header pipes.

23. The heat exchanger of claim 20 wherein said rectangular plate member is made of aluminum clad plates having an aluminum core with brazing material coated on at least one surface.

24. The heat exchanger of claim 20 wherein said rectangular member is made of aluminum clad plates with brazing material coated on opposite surfaces of said aluminum plate.

25. The heat exchanger of claim 23 wherein after said rectangular plate member is formed into a tubular shape the ends of said joint portions are adapted to engage the ends of said fin units.

* * * * *